US006371423B1

(12) United States Patent
Miller

(10) Patent No.: US 6,371,423 B1
(45) Date of Patent: Apr. 16, 2002

(54) TUBULAR ROD AND POST ASSEMBLY

(75) Inventor: Craig Miller, Leawood, KS (US)

(73) Assignee: The Group Legacy, L.C., Kansas City, MO (US)

( * ) Notice: Subject to any disclaimer, the term of this patent is extended or adjusted under 35 U.S.C. 154(b) by 0 days.

(21) Appl. No.: 09/771,477

(22) Filed: Jan. 26, 2001

(51) Int. Cl.[7] ..... A47H 1/00

(52) U.S. Cl. ..... 248/211.123; 248/221.12; 248/211.1

(58) Field of Search ..... 248/221.12, 251, 248/316.8, 231.91; 411/383, 384, 546

(56) References Cited

U.S. PATENT DOCUMENTS

| | | | | | |
|---|---|---|---|---|---|
| 2,715,468 | A | * | 8/1955 | Waltz | 211/123 |
| 3,464,568 | A | * | 9/1969 | Hexter | 211/105.6 |
| 3,661,272 | A | * | 5/1972 | Di Panni, Jr. | 211/105.1 |
| D268,321 | S | | 3/1983 | Tegner | |
| D274,123 | S | | 6/1984 | Tegner | |
| 4,646,491 | A | * | 3/1987 | Munch | 52/207 |
| D299,110 | S | | 12/1988 | Jans | |
| 5,071,099 | A | * | 12/1991 | Kuo | 248/222.1 |
| D337,507 | S | | 7/1993 | Jans | |
| 5,664,751 | A | * | 9/1997 | Lan | 248/251 |
| 5,860,538 | A | * | 1/1999 | Duero et al. | 211/123 |
| 5,878,976 | A | * | 3/1999 | Duck | 242/596.1 |
| 5,950,961 | A | * | 9/1999 | Duck | 242/596.1 |
| 6,012,692 | A | * | 1/2000 | Meck | 248/251 |
| 6,113,045 | A | * | 9/2000 | Kuo | 248/222.14 |
| 6,247,602 | B1 | * | 6/2001 | Klein et al. | 211/198 |
| 6,250,044 | B1 | * | 6/2001 | Funk et al. | 52/782.1 |

* cited by examiner

*Primary Examiner*—Anita King
*Assistant Examiner*—Kofi A Schulterbrandt
(74) *Attorney, Agent, or Firm*—Hovey Williams LLP

(57) ABSTRACT

A tubular rod and post assembly is provided which facilitates customizing the length of the rod to the desired application. The rod has first and second ends, at least one of which is tubular having a channel with an interior surface and an exterior surface. At least one and preferably both posts are symmetrical about a bisecting plane to provide a pair of recesses connected by a central passage, the recesses being complementally sized and configured to receive one or either of the ends of the rod therein. An insert is provided in each post, the insert including a body sized complementally to the interior surface of the rod, whereby the rod may be supported between the receiver around the recesses and the insert which passes partway into the channel. A finial may be positioned in the opposite recesses of each post and coupled to a threaded shank on the insert. An elastomeric ring may be provided on the body of the insert to frictionally engage the interior surface of the rod to inhibit turning of the rod relative to the post or rattling of the post.

20 Claims, 1 Drawing Sheet

TUBULAR ROD AND POST ASSEMBLY

BACKGROUND OF THE INVENTION

1. Field of the Invention

The present invention concerns an assembly useful for holding and retaining a tubular rod. More particularly, it is concerned with an assembly useful in a kitchen or bathroom as a towel bar or the like which provides a structural attachment for a tubular rod and facilitates installation and improves the appearance in use.

2. Description of the Prior Art

Towel bars are well known bathroom and kitchen furnishings which enable the user to retain towels and the like in convenient locations for use. These towel bars typically include a post which may be mounted to a wall, door or other upright surface and a rod which extends between the posts and on which the towels may be draped. These towel bars are intended for lightweight use, and typically the rod is of metal such as brass and tubular in order to most efficiently use the material for such lightweight applications.

Unfortunately, these towel bars are typically designed for predetermined lengths of the rod which makes adapting the towel bar assembly for different lengths in different environments difficult. If the tubular rod is shortened by cutting and removing a portion thereof, a metal bur is often left at the end of the rod. Moreover, the cut end of the rod may be difficult to reattach to the post and present an unsightly appearance.

Such towel bars may also, by necessity rather than design, be used as temporary hand holds by individuals in a bathroom or kitchen. When a force is suddenly applied by a user grabbing a towel bar to prevent or limit a slip or fall, the connection between the tubular rod and the posts carrying it may cause the rod to break free from the post. At a minimum, a cylindrical rod may freely rotate and slip in the user's hand. Thus, even though a towel bar is not intended to be used as a grab handle, it may be the only object within the grasp of the occupant of the space and thereby subjected to temporary increased force.

SUMMARY OF THE INVENTION

It is an object of the present invention to provide a tubular rod and post assembly which provides improved structural support for the rod while providing an elegant appearance.

It is another object of the present invention to provide a tubular rod and post assembly which facilitates cutting of the rod to different lengths for a particular application without detracting from the appearance of the assembly or the structural support for the rod.

It is a further object of the present invention to provide improved structural support for tubular rods at the point of connection to their posts.

These objects are largely met by the present invention in an economically acceptable way by the tubular rod and post assembly of the present invention. That is to say, the tubular rod and post assembly provides a sturdy and attractive support useful as a towel bar or the like, facilitates installation by concealing the ends of the rod within the posts, and provides improved support at the point of connection of the rod to the post in order to inhibit separation of the rod from the post, Further, the assembly hereof permits the use of a cylindrical tubular rod allowing rotation of the rod within the post while resisting such rotation.

Broadly speaking, the tubular rod and post assembly of the present invention includes a rod having at least one end having a channel, and a pair of posts, at least one of which has a recess complemental to the exterior surface of the rod and a rod insert sized complemental to the interior surface of the rod at the channel. The rod is extends between the posts and connected to each of them. Preferably, the rod is tubular throughout and each of the posts is provided with a recess and insert whereby the rod is separate from but connectable to each of the posts, the insert fitting into each respective end of the rod while at the same time the respective ends are fitted into the recess. The inserts thus provide an internal support for the ends of the rod while the recesses provide external support for the ends of the rod. Most preferably, an elastomeric ring is provided over the recess which grips against the interior surface of the rod. When the rod ends are cylindrical, the rings permit but resist rotation of the rod within the recess. The posts are adapted for mounting to an upright supporting surface, such as by a threaded member.

The tubular rod and post assembly facilitates adjustment in the length of the rod for a particular installation while maintaining the appearance of the assembly. One end of the rod may be cut and a portion removed to shorten the length of the rod. The cut end of the rod should be deburred. The rod, even with an uneven cut, may then be inserted into the recess. Because the insert fits into the interior surface of the cut end, it remains supported both internally and externally by the post, and retains the same structural connection as if the rod were not shortened in length.

These and other advantages will be readily appreciated by those skilled in the art with reference to the description and drawings regarding the preferred embodiment below, while the scope of my invention is to be determined from the claims as set forth below.

DESCRIPTION OF THE PREFERRED EMBODIMENT

Figure 1:
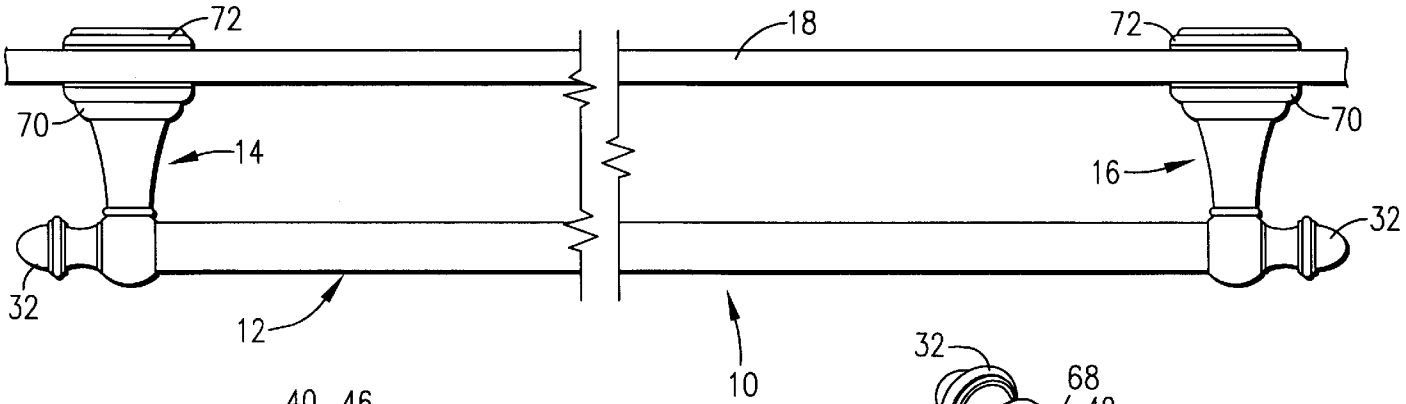
FIG. 1 is a top plan view of the tubular rod and post assembly hereof shown attached to a supporting surface, the break in the center of the rod showing that the rod may be of varying lengths.
Figure 3:
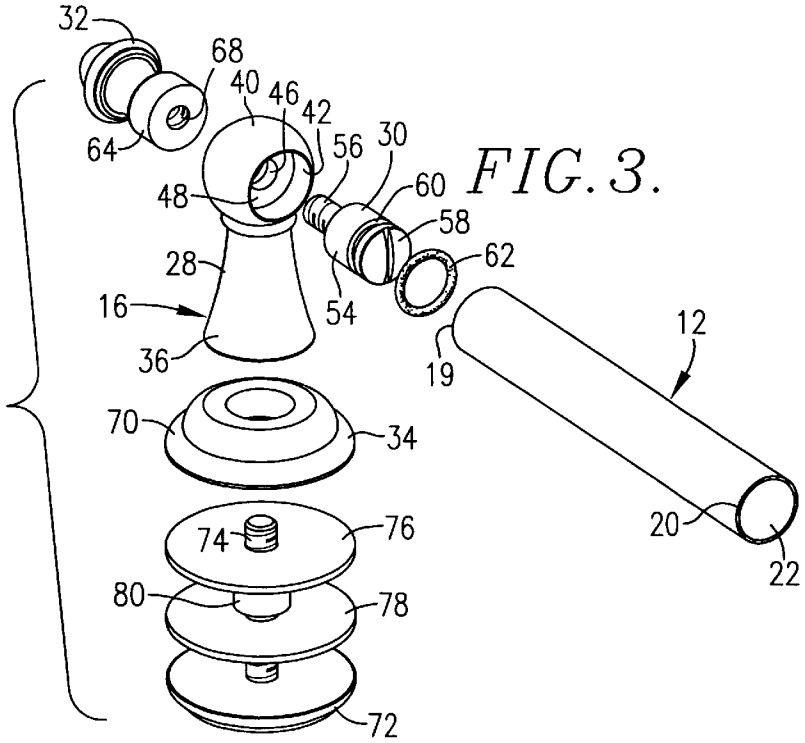
FIG. 3 is an exploded perspective view of one of the posts and the rod of the assembly hereof, showing the finial for threadably receiving the insert opposite the insert and rod.
Figure 2:
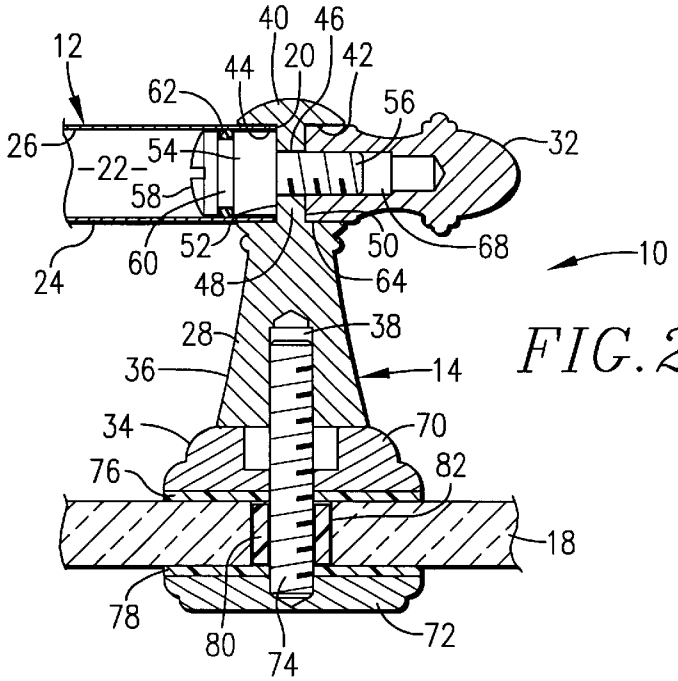
FIG. 2 is an enlarged, fragmentary cross-sectional view through a post and tubular rod of the assembly hereof, showing the insert coupled to the post and extending into the channel of the rod and the rod received in the recess of the post.

Referring now to FIG. 1 of the drawing, a tubular rod and post assembly 10 in accordance with the present invention broadly includes a tubular rod 12 and a pair of posts 14, 16 each adapted for mounting on a supporting surface 18 such as a sheet of wood, glass, wallboard, or other support which typically lies in a substantially upright plane. The rod 12 may be solid other than having ends 19 and 20 each of which have a channel 22 as shown in FIG. 2. Further, the rod may be curved or angled, as well as the elongated substantially linear rod 12 as shown in FIGS. 1, 2 and 3. While the rod 12 may be provided with an exterior surface 24 which is eliptical, polygonal, or other shape in cross-section, it is most preferably an elongated, substantially cylindrical tubular rod of metal such as brass, the exterior surface 24 and the interior surface 26 each being circular in cross-section.

The posts 14 and 16 are shown in greater detail in FIGS. 2 and 3 and include an extension 28, an insert 30, a finial 32 and mount 34. The extension 28 has a neck 36 which may be provided with an internally threaded bore 38, and a receiver 40 which is positioned relatively remotely from the supporting surface 18 when in use. In the preferred embodiment illustrated, the receiver 40 has opposed recesses 42 and 44 which are connected by a central passage 46. The recesses 42 and 44 are complementally configured to the exterior surface 24 of the rod 12, and as shown are thus circular in cross section having a diameter only slightly greater than the diameter of the exterior surface 24 of the rod 12. Each of the recesses 42 and 44 are similarly sized and thus are mirrored relative to one another, each opening so as to be in substantially linear alignment and back-to-back with one another. A central wall 48 separates the recesses 42 and 44 except for the interconnecting central passage 46, with the wall 48 having shoulders 50 and 52.

The insert 30 includes a body 54 and a longitudinally aligned threaded shank 56 of sufficient length to extend through the central passage 46 and thread onto the finial 32 as shown in FIG. 2. The body 54 is complementally configured with the interior surface 26 of the channel 22 of the rod 12, and thus in the preferred embodiment illustrated, is substantially circular in cross section. The body 54 has a slotted head 58 to facilitate turning of the insert 30 by a screwdriver, although it may be appreciated that it may also be configured with an internal recess for receiving an allen wrench, torx screwdriver, or a hex nut to permit turning by other screwdrivers or wrenches. However, the provision of a head 58 which is complemental to the interior surface 26 of the tubular rod 12 lends additional support during use. The body 54 also has a circumscribing slot 60 for receiving thereon an elastomeric ring 62 of rubber or the like, which engages the interior surface 26 of the rod 12. The body 54 is preferably of sufficient length relative to the depth of the recesses 42 and 44 such that when the insert 30 is inserted into one of the recesses and the finial 32 is mounted to the shank 56, the head 58 is located outside of the recess as shown in FIG. 2.

The finial 32 includes a hub 64 and a decorative extension 66. The hub 64 has an internally threaded opening 68 for threadably receiving the shank 56 therein. The hub 64 is configured to be received into the recess 42 or 44 which does not receive the insert 30.

The mount 34 may be variously configured depending on the supporting surface to which it is coupled as is well known in the art, so that it may be provided with plates, screws or other fasteners to mount to a wall, door, or the like. In the preferred embodiment illustrated herein, the mount 34 includes an escutcheon 70, a backing 72 which threadably receives a stud 74, seals 76 and 78, and grommet 80 of elastomeric material such as synthetic rubber which centers the stud within an opening in the supporting surface 18 and protects it from wear. This is especially important for brittle or easily damaged supporting surfaces such as glass panels. The stud 74 threads into the bore 38 of the neck 36 to couple the posts 14 and 16 to the supporting surface 18.

It may be appreciated that rod 12 has two opposite ends, and the present invention permits providing the rod 12 of a sufficient length that it may be cut and thereby shortened to length for a desired, customized application. Thus, it is not necessary to provide a number of different rods 12, but rather a standard length of rod may be shortened to a desired length corresponding to the positioning of the posts 14 and 16. Once sized to the desired length, the rod ends 19 and 20 are coupled to respective posts 14 and 16. The insert 30 is inserted into one of the recesses 42 and 44 of the receiver with the shank 56 passing through the central passage 46. The hub 64 of the finial 32 is then threaded onto the shank 56 until the hub 64 and the insert 30 are fully seated against the central wall 48. As shown in FIG. 2, each end of the rod is fitted over the body 54 of the insert 30 and the ring 62 carried thereon, and fitted into one of the recesses 42 or 44. The stud 74 of each mount is then passed through a hole 82 in the supporting surface 18 and threaded into the bore 38 of the neck 36 to securely mount the assembly 10 to the supporting surface as shown in FIG. 1.

The tubular rod and post assembly 10 hereof thus readily accomodates adjustment of the length of the tubular rod 12 by effectively hiding from view and touch any rough or uneven ends of the rod, while improving the strength of the connection between the rod and each post by providing both internal and external support for the rod. The rod may be turned within the recesses of the posts, but to do so requires a conscious effort to overcome the frictional engagement of the ring with the interior surface of the rod. This provides an improved function for towel bars and the like by largely eliminating the loose fitting and consequent rattling between the rod and the posts.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A tubular rod and post assembly adapted for mounting to a supporting surface comprising:

a rod having an exterior surface and an interior surface and first and second opposed ends, at least said first end being tubular and having a channel defined by said interior surface therein; and a plurality of posts coupled to and supporting said rod therebetween and adapted for mounting to a supporting surface, at least one of said posts including a recess complementally configured to the exterior surface of said first end of said rod and receiving said first end therein, and an insert located in said recess, said insert including a body which engages substantially the entire circumferential interior surface portion of said rod at said first end and is complementally configured for receipt into the channel of said first end.

2. An assembly as set forth in claim 1, wherein said channel extends between said first and second ends the length of said rod.

3. An assembly as set forth in claim 2, wherein the other of said posts includes a respective recess and a second insert located therein, said second end of said rod being received in said recess of the other of said posts and the second insert of the other of said posts being received in the channel at said second end.

4. An assembly as set forth in claim 1, each of said posts having a mount coupling the post to the supporting surface.

5. An assembly as set forth in claim 4, wherein said posts each include a threaded bore and said mount includes a threaded member received in said bore.

6. An assembly as set forth in claim 5, wherein said mount includes a backing threadably receiving said threaded member.

7. A tubular rod and post assembly adapted for mounting to a supporting surface comprising:

a rod having first and second opposed ends, at least said first end being tubular and having a channel therein; and a plurality of posts coupled to and supporting said rod therebetween and adapted for mounting to a supporting surface, at least one of said posts including a recess complementally configured to the first end of said rod and receiving said first end therein, and an insert located in said recess and complementally configured for receipt into the channel of said first end, wherein said post includes a receiver having a first recess and a second recess separated by a wall, said first recess and said second recess being aligned and opening opposite to one another.

8. An assembly as set forth in claim 7, said receiver further including a central passage interconnecting said first and second recesses.

9. An assembly as set forth in claim 8, wherein said insert includes a body received in said first recess and a threaded shank extending through said passage and into said second recess.

10. An assembly as set forth in claim 9, including a finial having a hub received in said second recess and threadably coupled to said shank of said insert.

11. An assembly as set forth in claim 1, wherein said exterior surface is circular in cross-section and said interior surface is circular in cross-section.

12. A tubular rod and post assembly adapted for mounting to a supporting surface comprising:

a rod having first and second opposed ends, at least said first end being tubular and having a channel therein; and a plurality of posts coupled to and supporting said rod therebetween and adapted for mounting to a supporting surface, at least one of said posts including a recess complementally configured to the first end of said rod and receiving said first end therein, and an insert located in said recess and complementally configured for receipt into the channel of said first end, said insert including a body received in and extending from said recess, said body including a circumscribing slot, and further including an elastomeric ring received in said slot for frictional engagement with an interior surface of said rod.

13. An assembly as set forth in claim 1, said insert including a threaded shank and body having a slotted head opposite said threaded shank.

14. A tubular rod and post assembly comprising:

an elongated tubular rod having a channel extending therethrough, said rod having first and second ends each having a substantially circular exterior surface and a substantially circular interior surface;

a pair of posts adapted for mounting to a supporting surface coupled to and supporting said rod therebetween, each of said posts each including:

first and second aligned, opposed recesses complementally configured to the exterior surface of said ends of said rod for receiving one of said ends therein, a passage having a transverse dimension smaller than that of said recesses and communicating with said recesses;

an insert having a body received in one of said recesses, said body being complementally configured to the interior surface for receipt in the channel;

a finial received in the other of said recesses and threadably coupled to said insert; and a mount adapted for coupling the post to supporting surface.

15. An assembly as set forth in claim 14, wherein said insert includes a threaded shank extending through said passage and threadably coupled to said finial.

16. An assembly as set forth in claim 14, wherein said insert includes a circumscribing slot receiving an elastomeric ring positioned between said insert and said rod.

17. A method of mounting a rod and post assembly to a supporting surface comprising the steps of:

providing a rod and a pair of supporting posts, at least one of said posts including a receiver having a recess complementally sized to receive a portion of the rod therein and an insert located in the receiver;

cutting said rod to a desired length to provide first and second ends, at least one of said ends being tubular having a channel therein, the rod having an exterior surface complementally configured with said recess and the channel having an interior surface complementally configured for fitting over the insert and for holding the rod between the insert and the receiver, said interior surface being substantially congruous with said outer surface;

coupling said rod to each of said posts whereby at least said one end of said rod is inserted into said receiver and over said insert of one of said posts whereby said at least one end of said rod is held between said receiver and said insert along substantially the entire axial length of the exterior surface received in said recess; and mounting said assembly to a supporting surface.

18. An assembly as set forth in claim 1, wherein said recess has an axial length and said body has an axial length substantially the same as the axial length of said recess and said body is concentrically positioned within said recess to engage said rod along both the axial length of said recess and the axial length of said body.

19. A tubular rod and post assembly adapted for mounting to a supporting surface comprising:

a rod having tubular first and second opposed ends, at least one of said ends being tubular and having en exterior surface and an interior surface which are congruous with one another; and a plurality of posts coupled to and supporting said rod therebetween and adapted for mounting to a supporting surface, at least one of said posts including a recess complementally configured to the exterior surface of said first end of said rod and receiving said first end therein, and an insert located in said recess and having a body which is complementally configured with said interior surface and received within said channel in engagement with said interior surface at said first end for holding said first end between said insert and said recess.

20. A method of mounting a rod and post assembly as set forth in claim 17, wherein said insert includes a threaded shank extending axially from said first end and said post includes a second recess opening away from the first recess and a passage connecting the first recess and the second recess, and further including providing a finial configured to be threaded onto said shank, and including the steps of positioning said insert whereby said threaded shank extends into said passage and threadably coupling said finial to said shank.

* * * * *